US007243917B2

(12) United States Patent
Knierim et al.

(10) Patent No.: US 7,243,917 B2
(45) Date of Patent: Jul. 17, 2007

(54) PRINT MEDIA REGISTRATION USING ACTIVE TRACKING OF IDLER ROTATION

(75) Inventors: David L. Knierim, Wilsonville, OR (US); Lloyd A. Williams, Mahopac, NY (US); Joannes N. M. deJong, Hopewell Junction, NY (US)

(73) Assignee: Xerox Corporation, Stamford, CT (US)

( * ) Notice: Subject to any disclaimer, the term of this patent is extended or adjusted under 35 U.S.C. 154(b) by 408 days.

(21) Appl. No.: 10/855,451

(22) Filed: May 27, 2004

(65) Prior Publication Data

US 2005/0263958 A1 Dec. 1, 2005

(51) Int. Cl.
*B65H 7/02* (2006.01)

(52) U.S. Cl. ..... 271/228; 271/227

(58) Field of Classification Search ..... 271/226, 271/227, 228, 253, 254, 207, 176, 272, 314; 414/791.2; 399/395; 400/579
See application file for complete search history.

(56) References Cited

U.S. PATENT DOCUMENTS 4,511,242 A 4/1985 Ashbee et al.
4,971,304 A 11/1990 Lofthus
5,021,673 A * 6/1991 Dragon et al. ..... 250/548
5,078,384 A 1/1992 Moore
5,090,683 A * 2/1992 Kamath et al. ..... 271/227
5,094,442 A 3/1992 Kamprath et al.
5,105,363 A * 4/1992 Dragon et al. ..... 700/225
5,156,391 A 10/1992 Roller
5,169,140 A 12/1992 Wenthe
5,172,907 A * 12/1992 Kalisiak ..... 271/227
5,219,159 A 6/1993 Malachowski et al.
5,278,624 A 1/1994 Kamprath et al.
5,337,133 A 8/1994 Siegel et al.
5,440,979 A * 8/1995 Bonham et al. ..... 101/91
5,662,321 A * 9/1997 Borostyan et al. ..... 271/10.03
5,678,159 A 10/1997 Williams et al.
5,697,608 A 12/1997 Castelli et al.
5,731,680 A * 3/1998 Winterberger et al. ..... 318/685
5,794,176 A 8/1998 Milillo
5,848,344 A 12/1998 Milillo
6,173,952 B1 1/2001 Richards et al.
6,499,734 B1 * 12/2002 Tranquilla ..... 271/10.03
6,533,268 B2 3/2003 Williams et al.
6,575,458 B2 6/2003 Williams et al.
6,641,134 B1 * 11/2003 Dobbertin et al. ..... 271/226
6,834,853 B2 * 12/2004 Trovinger et al. ..... 271/227
6,910,689 B2 * 6/2005 Carolan ..... 271/228

(Continued)

FOREIGN PATENT DOCUMENTS

JP 03243551 A * 10/1991

*Primary Examiner*—Patrick Mackey
*Assistant Examiner*—Jeremy R Severson

(57) ABSTRACT

More accurately correcting sheet position and skew in a desired print media sheet trajectory in a printer paper path, with a registration system including sheet drive nips defined by laterally spaced and differentially driven elastomer surfaced frictional sheet drive rollers and mating undriven idler rollers have a non-slip rotational sheet engagement. The undriven idler rollers have rotary encoders producing encoder signals corresponding to their rotation by a sheet in the nip, which encoder signals are provided to a controller for the registration system to control forward and differential drive motor systems for the sheet drive rollers so as to substantially correct for errors in the desired trajectory of said sheet by sheet drag forces acting on the elastomer surfaced sheet drive rollers in the sheet drive nips.

9 Claims, 3 Drawing Sheets

U.S. PATENT DOCUMENTS

Figure 1:
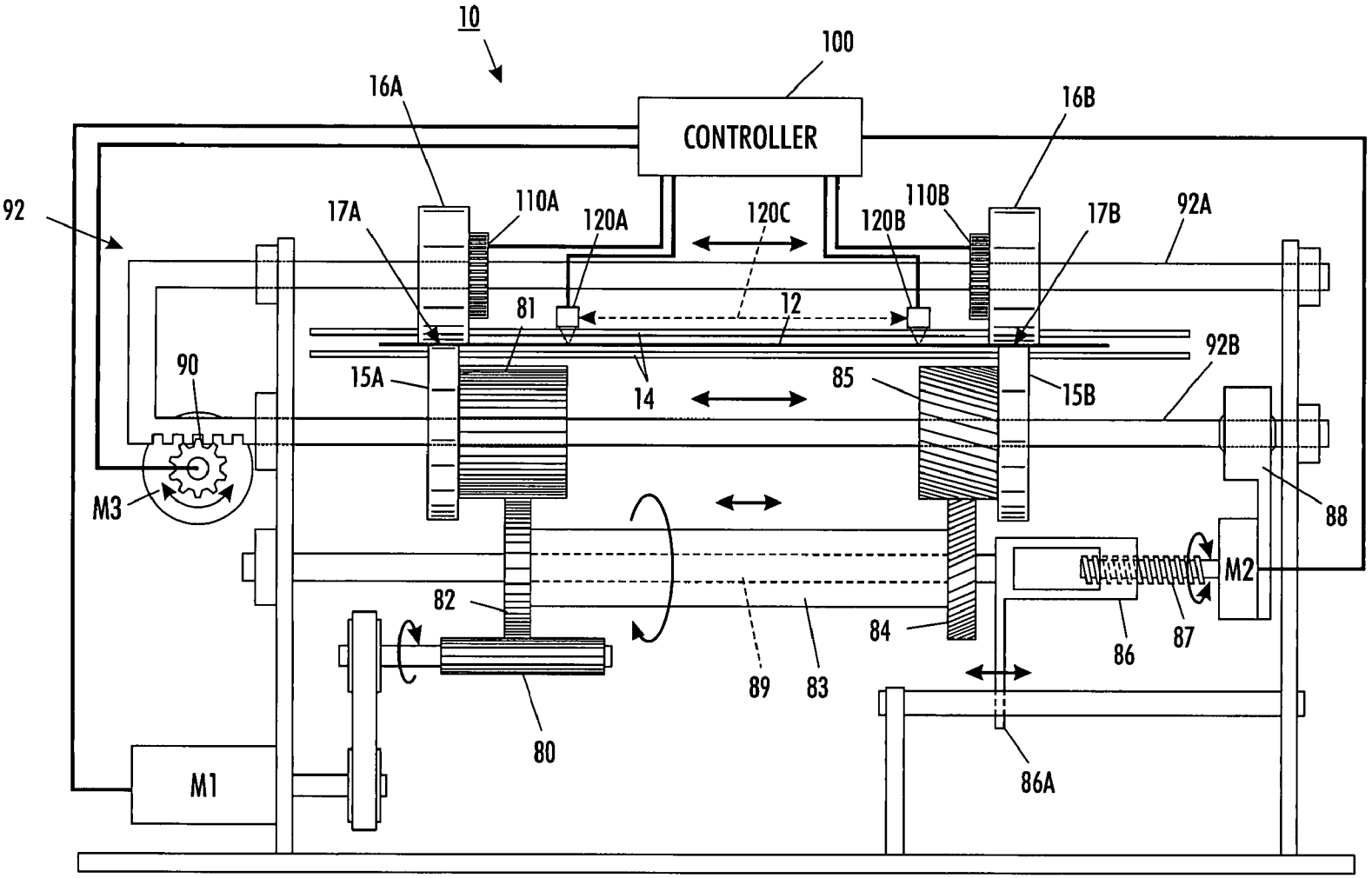

2003/0020230 A1 1/2003 Williams et al.
2003/0020231 A1 1/2003 Williams et al.
2003/0146567 A1 8/2003 Williams et al.
2004/0046313 A1 3/2004 Herrmann et al.

* cited by examiner

PRINT MEDIA REGISTRATION USING ACTIVE TRACKING OF IDLER ROTATION

Cross-reference and incorporation by reference is made to commonly-owned U.S. patent application Ser. No. 10/369,811, filed Feb. 19, 2003 now U.S. Pat. No. 6,866,260, issued Feb. 19, 2003, (U.S. Publication No. 20030146567, published Aug. 7, 2003), which is a continuation-in-part of U.S. patent application Ser. No. 09/916,993, filed Jul. 27, 2001, by Lloyd A. Williams et al, now U.S. Pat. No. 6,533,268, issued Mar. 18, 2003 (U.S. Publication No. 20030020230, published Jan. 30, 2003).

Disclosed in the embodiment herein is an improved system and method for sheet registration and/or sheet deskewing in the sheet registration system. In particular, an improved system for controlling, correcting or changing the orientation and position of sheets traveling in a sheet transport path. More particularly, but not limited thereto, sheets being printed in a reproduction apparatus, which may include sheets being fed to be printed, sheets being recirculated for second side (duplex) printing, and/or sheets being outputted to a stacker, finisher or other output or module.

Various automatic sheet registration, including sheet deskewing, systems are known in the art. The below-cited patent disclosures are noted by way of some examples. They demonstrate the long-standing efforts in this technology for more effective sheet registration, particularly for printers (including, but not limited to, xerographic copiers and printers). The disclosed embodiment provides increased registration accuracy that compensates for sheet driving errors in the sheet corrective drive system of a registration system by measuring the actual sheet trajectory during the sheet corrective action by the registration system. As shown, it has been found that this can be accomplished using rotary encoders encoding the rotation of the undriven non-slip idler rollers that are nipped with the opposing sheet driving rollers of the registration system.

Also noted by way of background as to commonly owned U.S. patents or applications on so-called "TELER" ("Translation ELEctronic Registration") or ELER sheet deskewing and/or side registration systems are U.S. Pat. No. 6,575,458 filed Jul. 27, 2001 and issued Jun. 10, 2003 by Lloyd A. Williams et al (U.S. Publication No. 20030020231, published Jan. 30, 2003); and U.S. patent application Ser. No. 10/237,362, filed Sep. 6, 2002 by Douglas K. Herrmann, now U.S. Pat. No. 6,736,394, issued May 18, 2004, (U.S. Publication No. 20040046313, published Mar. 11, 2004). Various "ELER" systems do only skew and process direction position correction, without sheet side shift lateral registration. The latter may be done separately or not at all. The present improvement is applicable to both and is not limited to either. In either ELER or TELER systems, initial or incoming sheet skew and position may measured with a pair of lead edge sensors, and then two or more ELER or TELER drive rollers (having two independently driven, spaced apart, inboard and outboard nips) may be used to correct the skew and process direction position with an open loop control system in a known manner. Some ELER systems use one servomotor for process direction correction and another motor (e.g. a stepper motor) for the differential actuation for skew correction, as variously shown in Xerox Corp. U.S. Pat. Nos. 6,575,458 and 6,535,268 cited above. However, as shown in the cited art, there are also prior ELER systems with separate servo or stepper motors independently driving each of the two laterally spaced drive nips for process direction registration and sheet skew registration. The present improvement is also applicable to those systems.

A problem that has been discovered with either registration system is that variable sheet drag on the sheets of the paper from baffles, especially curved baffles and/or paper pre-heaters, and other factors, can cause unacceptable random variations in TELER, ELER (or other) registration system performance.

Further by way of background, as is well known, many sheet transport systems including most TELER and ELER systems use a frictional force drive nip to impart velocity to a sheet. Typically, a nip consists of a motor driven elastomeric surface wheel or "drive roller" and a backup wheel or "idler roller" that is spring loaded against the drive roller to provide sufficient normal force for a normally non-slip drive of the sheet. A well known example of the drive roller surface is a urethane material. In contrast, the idler roller (wheel) is usually a hard substantially inelastic material (metal or hard plastic). The angular velocity of the drive nip has heretofore typically been measured with the encoder in or on the servo or stepper motor driving the drive roll. Ideally, the ratio of linear paper speed to the calculated drive nip surface velocity (angular velocity multiplied by radius) should be unity. However, when such a nip moves a sheet, other imposed forces on the sheet, as discussed herein, can affect the actual velocity of the sheet. As further discussed herein, the elastomer material or coating on the drive roller can cause this drive ratio to be less than unity. The elastomer also makes the drive nip sensitive to imposed drag forces on the paper, and other factors affecting the actual drive ratio.

As noted above, many paper registration systems in printers use two drive nips (inboard and outboard nip) as part of the paper path delivering the sheet from an input location to an image transfer position. At this image transfer position an image is transferred to the sheet. In order for the image to be properly positioned on the sheet, the sheet position (in both process direction and skew) must be within defined desired specifications, even though the arrival position of the sheet at the image transfer position may be downstream from the two variable speed drive nips or other paper registration system providing the sheet to image registration. Typically, the position of the sheet is measured at an input location and a desired sheet trajectory is calculated. From that desired sheet trajectory, the desired nip velocities are calculated. That is, the average of the two nips will determine the process direction position correction and the differential velocity of the two nips will determine the skew registration correction. However, the above-noted drive ratio error effect will cause that desired paper trajectory to differ from the actual paper trajectory. This can lead to significant output registration errors that are outside of the defined desired specifications. The sheet may not be sufficiently accurately aligned or overlaid with one or more print images.

Some of the observed causes of such drive ratio variations are as follows:

1. Variable nip loading forces—if the (spring) load force of the idler nip (the nip normal force) varies, so can the drive ratio. An increase in nip loading force can deform and reduce the effective drive radius of the elastomeric drive roller. Furthermore, a difference in nip loading forces between the inboard and outboard drive nips can produce a skew.
2. Baffle drag forces, especially from curved baffles.
3. Heater induced drag forces. The paper registration system for a solid ink printer, for example, may contain parallel plate paper pre-transfer heaters heating the paper with intimate contact conductive heat transfer in the paper path near enough to the paper registration system drive nips so that a sheet in the registration system drive nips is also engaging a heated surface. Variable friction forces between the paper and the heater can cause variable drag forces inboard to outboard. These variations can become quite large when partially imaged sheets are being registered for their second imaging pass in a duplex printing operation. This can cause particularly large drive ratio variations and hence registration system errors.

It is particularly desirable for high speed printing for the sheet deskewing and any other sheet registration to be done while the sheets are kept moving along a paper path at a defined and substantially constant speed, without sheet stoppages or rapid sheet accelerations or decelerations. This is also known as sheet registration "on the fly." Prior registrations systems have had some difficulties even with these constraints, which the system disclosed herein addresses. In particular, meeting increased sheet positional accuracy requirements relative to image positions for increased printing quality. However, the improved sheet registration system disclosed herein is not limited to only high speed printing applications.

For faster printing rates, requiring faster sheet feeding rates along paper paths, which can reach more than, for example, 100-200 pages per minute, the desired registration systems and functions typically become much more difficult and more expensive. It is especially difficult to accomplish the desired sheet skew correction rotation and forward sheet positional correction during the brief time period and distance in which each sheet is in the sheet driving nips of the registration system. As noted, it is particularly desirable to be able to do registration including deskew "on the fly," while the sheet is moving through or out of the reproduction system at normal process (sheet transport) speed. Also desirable is to do so with a system that does not substantially increase the overall sheet path length, or increase paper jam tendencies.

Other non-TELER types of combined sheet lateral registration and deskewing systems are known in the art. For example, Xerox Corp. U.S. Pat. No. 6,173,952 B1, issued Jan. 16, 2001 to Paul N. Richards, et al (and art cited therein) (D/99110). That patent's disclosed additional feature of variable lateral sheet feeding nip spacing, for better control over variable size sheets, may be readily combined with or into various applications of the present invention, if desired.

The following additional patent disclosures, and other patents cited therein, are noted by way of some additional examples of sheet registration systems with various means for side-shifting or laterally repositioning the sheet: Xerox Corporation U.S. Pat. No. 5,794,176, issued Aug. 11, 1998 to W. Milillo; U.S. Pat. No. 5,678,159, issued Oct. 14, 1997 to Lloyd A. Williams, et al; U.S. Pat. No. 4,971,304, issued Nov. 20, 1990 to Lofthus; U.S. Pat. No. 5,156,391, issued Oct. 20, 1992 to G. Roller; U.S. Pat. No. 5,078,384, issued Jan. 7, 1992 to S. Moore; U.S. Pat. No. 5,094,442, issued Mar. 10, 1992 to D. Kamprath, et al; U.S. Pat. No. 5,219,159, issued Jun. 15, 1993 to M. Malachowski, et al; U.S. Pat. No. 5,169,140, issued Dec. 8, 1992 to S. Wenthe; and U.S. Pat. No. 5,697,608, issued Dec. 16, 1997 to V. Castelli, et al. Also, IBM U.S. Pat. No. 4,511,242, issued Apr. 16, 1985 to Ashbee, et al.

Of background interest are the alternative differential drive roller sheet deskewing systems of D. Kamprath et al U.S. Pat. No. 5,278,624, issued Jan. 11, 1994 including that of FIG. 3. While said U.S. Pat. No. 5,278,624 does not itself disclose any lateral sheet side shifting system, its Col. 2 lines 58-61 cites and incorporates by reference the above-cited U.S. Pat. No. 5,094,442, issued Mar. 10, 1992 to D. Kamprath, et al.

Various optical sheet lead edge and sheet side edge position detector sensors are known which may be utilized in such automatic sheet deskew and registration systems. Various of these are disclosed in the above-cited references and other references cited therein, or otherwise, such as the above-cited U.S. Pat. No. 5,678,159, issued Oct. 14, 1997 to Lloyd A. Williams, et al; and U.S. Pat. No. 5,697,608 to V. Castelli, et al.

Various of the above-cited and other patents show that it is well known to provide integral sheet deskewing and lateral registration systems in which a sheet is deskewed while moving through two laterally spaced apart sheet feed roller-idler nips, where the two separate sheet feed rollers are independently driven by two different respective drive motors. Temporarily driving the two motors at slightly different rotational speeds provides a slight difference in the total rotation or relative pitch position of each feed roller while the sheet is held in the two nips. That moves one side of the sheet ahead of the other to induce a skew (small partial rotation) in the sheet opposite from an initially detected sheet skew in the sheet as the sheet enters the deskewing system. Thereby deskewing the sheet so that the sheet is now oriented with (in line with) the paper path.

For printing in general, the providing of sheet skewing rotation and sheet registration while the sheet is being fed forward in the printer sheet path is a technical challenge, especially as the sheet path feeding speed increases. Print sheets are typically flimsy paper or plastic imageable substrates of varying thinnesses, stiffnesses, frictions, surface coatings, sizes, masses and humidity conditions. Various of such print sheets are particularly susceptible to feeder slippage, wrinkling, or tearing, especially when subject to excessive accelerations, decelerations, drag forces, path bending, etc.

In contrast to the above-cited Lofthus '304 type system of sheet lateral registration by deliberate skew inducement and removal, and in contrast to the above cited improved TELER systems, are other sheet side-shifting lateral registration systems in which the entire structure and mass of a carriage containing the two drive rollers, their opposing nip idlers, and the drive motors (unless splined drive telescopically connected), are axially side-shifted to side-shift the engaged sheet into lateral registration. However, even in such systems the sheet lateral registration movement can be done during the same time as, and independently of, the sheet deskewing movement. These may also be broadly referred to as "TELER" systems. For example, U.S. Pat. No. 5,094,442, issued Mar. 10, 1992 to Kamprath et al; U.S. Pat. No. 5,794,176 and U.S. Pat. No. 5,848,344, issued to Milillo, et al; U.S. Pat. No. 5,219,159, issued Jun. 15, 1993 to Malachowski and Kluger (citing numerous other patents); U.S. Pat. No. 5,337,133; and some other above-cited patents.

In various sheet registration systems the use of sheet position sensors, such as a CCD multi-element linear strip array sensor, could be used in a feedback loop for slip compensation to insure the sheet achieving the desired three-axis registration. See, for example, the above-cited U.S. Pat. No. 5,678,159 to Lloyd A. Williams, et al. However, that can have cost, complexity or other disadvantages.

A specific feature of the specific embodiment disclosed herein is to provide an improved sheet registration system for a moving sheets path for accurately correcting a sheet position relative to a desired sheet trajectory, said sheet registration system including a control system and at least one frictional sheet drive roller with a drive system and a mating undriven idler roller forming at least one sheet trajectory controlling sheet drive nip between said at least one frictional sheet drive roller and said mating undriven idler roller, wherein said mating undriven idler roller has non-slip rotational engagement with said sheet in said at least one sheet drive nip to rotate in correspondence with said sheet trajectory, and wherein said mating undriven idler roller has a rotary encoder connected thereto to produce encoder electrical signals corresponding to said rotation of said mating undriven idler roller, which encoder electrical signals are provided to said control system to control said drive system driving said at least one frictional sheet drive roller.

Further specific features disclosed in the embodiment herein, individually or in combination, include those wherein said at least one frictional sheet drive roller comprises a transversely spaced pair of such drive rollers with a differential drive system providing differential sheet drive nips, and said differential drive system is controlled by said control system to impart sheet trajectory controlling skew corrective motion including partial rotation of a sheet in said differential sheet drive nips; and/or wherein said moving sheets path is a paper path in a printer with at least two said sheet drive nips transversely spaced across said paper path with at least two said mating idlers, each with said connecting rotary encoders; and/or wherein said moving sheets path is a paper path in a printer with at least two said sheet drive nips transversely spaced across said paper path with at least two said mating idlers, each with said connecting rotary encoders, and wherein said rotary encoders are directly attached to said undriven idler rollers and said undriven idler rollers are all rotatably mounted on the same transverse shaft; and/or wherein said moving sheets path is a paper path in a printer upstream of an image transfer station at which images are to be printed on the sheets registered by said improved sheet registration system; and/or wherein at least the outer surface of said at least one frictional sheet drive roller has a partially deformable elastomeric frictional surface, and said mating undriven idler roller has a substantially non-deformable surface; and/or wherein said at least one frictional sheet drive roller has a partially deformable elastomeric frictional sheet driving surface of approximately 9 mm or more in width, and said mating undriven idler roller has a substantially non-deformable surface; and/or wherein said moving sheets path is a paper path in a printer with sheet path defining baffles and a sheet heating system imparting drag forces on said moving sheets in said at least one sheet trajectory controlling sheet drive nip; and/or an improved sheet registration method for a moving sheets path for accurately correcting an initially detected sheet position and skew relative to a desired sheet trajectory, said sheet registration method including a control system and at least two transversely spaced apart frictional sheet drive rollers driven by a differential drive system and having mating undriven idler rollers forming at least two sheet trajectory controlling sheet drive nips between said at least two frictional sheet drive rollers and said respective mating undriven idler rollers, wherein said at least two frictional sheet drive rollers and said differential drive system are controlled by said control system to impart corrective motion to said sheet in said sheet trajectory controlling sheet drive nips, wherein said mating undriven idler rollers have non-slip rotational engagement with said sheet in said at least two sheet trajectory controlling sheet drive nips to rotate in correspondence with said sheet trajectory, and wherein said mating undriven idler rollers have rotary encoders connected thereto producing encoder electrical signals corresponding to said rotation of said mating undriven idler rollers, which encoder electrical signals are provided to said control system to control said differential drive motor system driving said at least two frictional sheet drive rollers to substantially correct for errors in said driving of said sheet by said frictional sheet drive rollers in said sheet trajectory controlling sheet drive nips; and/or wherein said moving sheets path is a paper path in a printer; and/or wherein said moving sheets path is a paper path in a printer upstream of an image transfer station at which images are printed on the sheets registered by said improved sheet registration method; and/or wherein said rotary encoders are directly attached to said undriven idler rollers and said undriven idler rollers are all rotatably mounted on the same transverse shaft; and/or wherein at least the outer surface of said frictional sheet drive rollers has a partially deformable elastomeric frictional surface, and said mating undriven idler rollers have a substantially non-deformable surface, and wherein said moving sheets path is a paper path of a printer with sheet path defining baffles imparting drag forces on said moving sheets when said sheets are in said in said sheet trajectory controlling sheet drive nips, which drag forces are sufficient to cause partial deformation of said partially deformable elastomeric frictional surface of said frictional sheet drive rollers; and/or a sheet registration method for a moving sheets path of a printer for more accurately correcting an initially detected sheet position relative to a desired sheet trajectory, said sheet registration method including a control system and transversely spaced apart elastomer surface frictional sheet drive rollers driven by a drive motor system and having mating undriven non-elastomeric idler rollers forming sheet trajectory controlling sheet drive nips between said frictional sheet drive rollers and said respective mating undriven idler rollers, said sheet trajectory controlling sheet drive nips providing forward driving of a sheet therein, said mating undriven idler rollers having rotary encoders producing encoder signals directly corresponding to the rotation of said mating undriven idler rollers, which encoder signals are provided to said control system to control said sheet drive rollers to correct for errors in said desired trajectory of said sheet caused by sheet drag forces acting on said elastomer surface sheet drive rollers in said sheet drive nips; and/or wherein the distance between said sheet drive nips and a downstream sheet drive nip divided by the circumference of said idler rollers is approximately an integer; and/or wherein said sheet drive nips are approximately 6 to 12 mm wide.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed. A "copy sheet" may be abbreviated as a "copy" or called a "hardcopy." A "simplex" document or copy sheet is one having its image and any page number on only one side or face of the sheet, whereas a "duplex" document or copy sheet normally has printed images on both sides.

As to specific components of the subject apparatus or methods, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the examples cited above and below, and the claims. Thus, the present invention will be better understood from this description of a specific embodiment, including the drawing figure (which is approximately to scale) wherein:

FIG. 1 is a partially schematic transverse view, partially in cross-section for added clarity, of one embodiment of an improved sheet registration system with a dual nip automatic differential deskewing system in an exemplary printer paper path. In this example this is a TELER registration system, optionally also providing lateral as well as forward (downstream or process direction) sheet feeding movement and registration and deskew, and similar in that respect to the FIG. 6 embodiment of the above-cited U.S. patent application Ser. No. 10/369,811, filed Feb. 19, 2003, now U.S. Pat. No. 6,866,260, issued Feb. 19, 2003, (USPTO Publication No. 20030146567, published Aug. 7, 2003).

Figure 2:
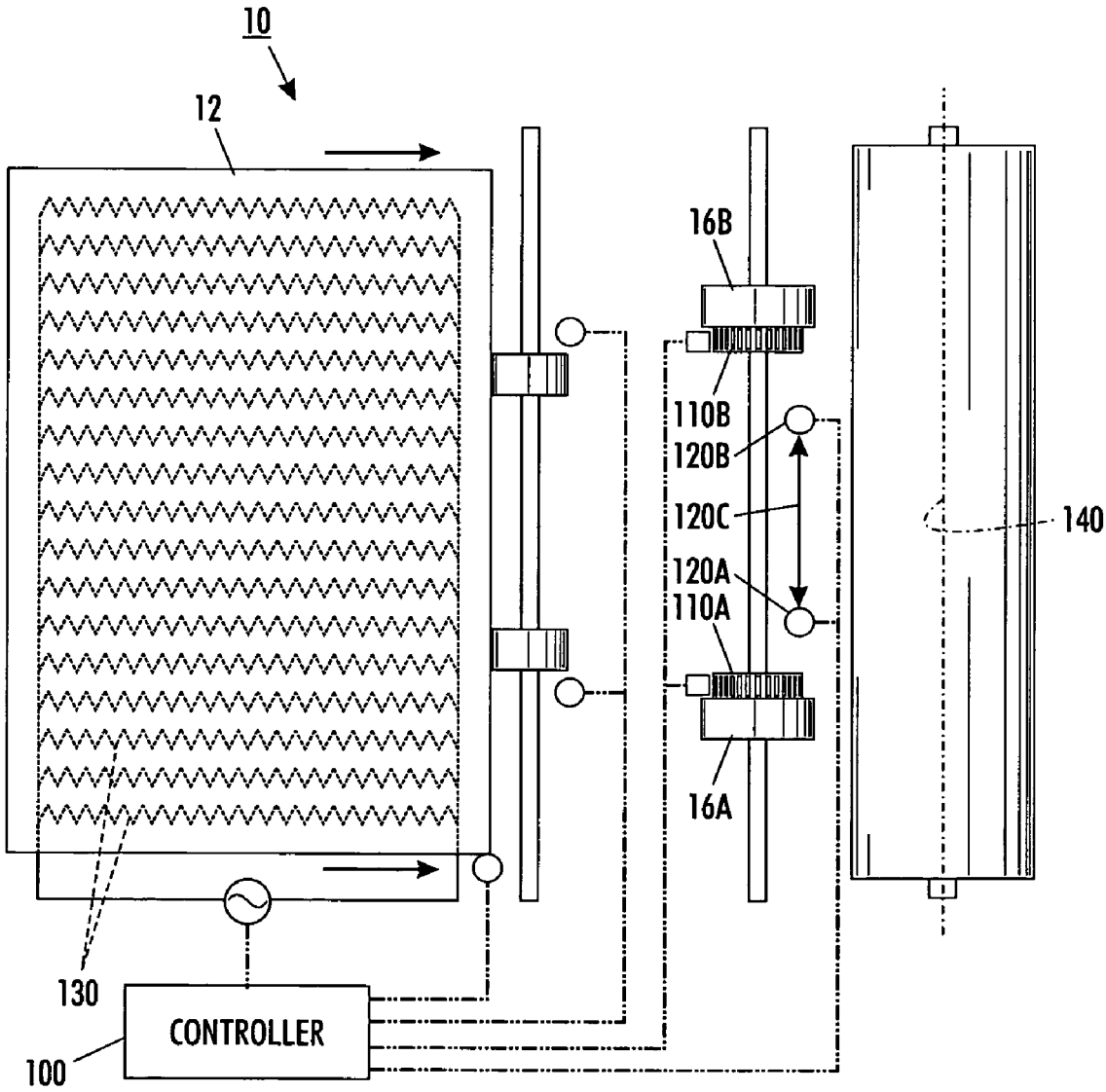
Figure 3:
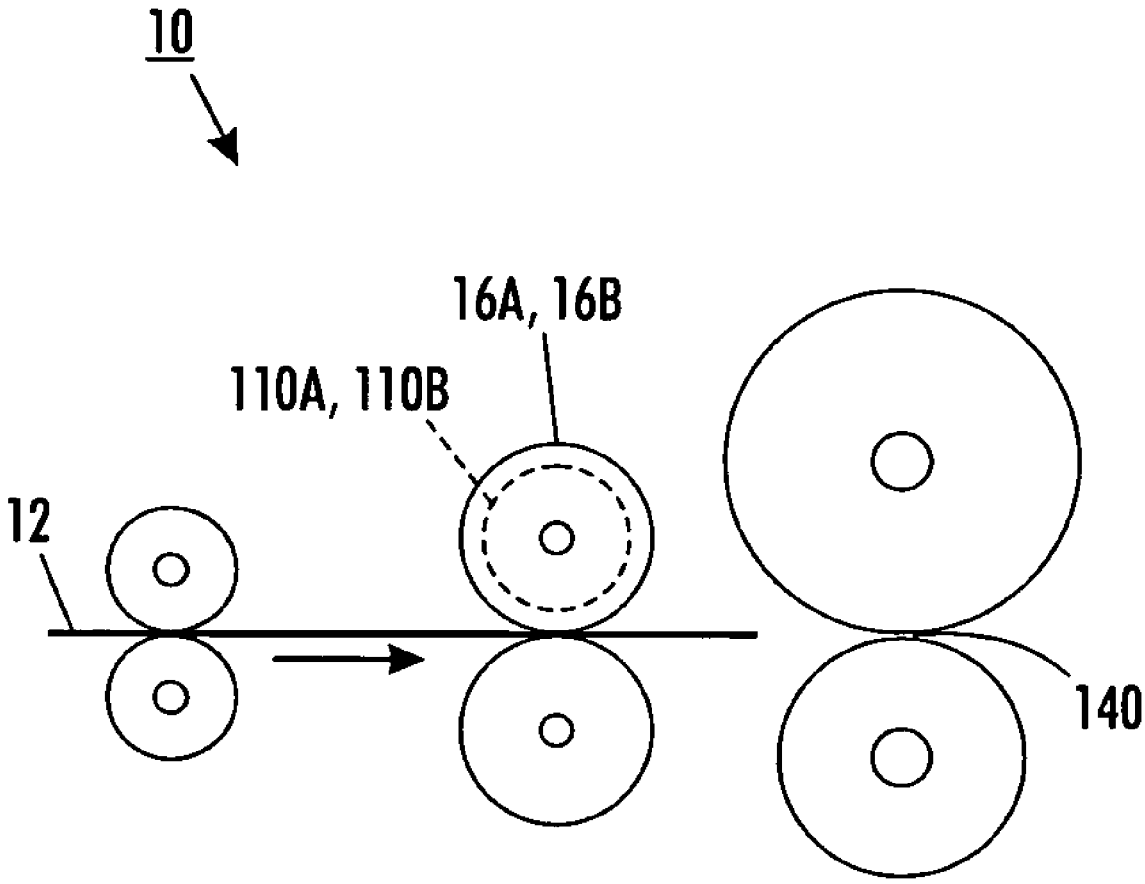

FIG. 2 is a simplified schematic top view of the sheet registration system of FIG. 1, and FIG. 3 is a simplified schematic side view of the embodiment of FIGS. 1 and 2.

Describing now in further detail this FIG. 1 example of a registration system 10 providing automatic sheet deskewing and sheet process direction registration, it will be first be noted the present system and method of improved sheet trajectory accuracy is not limited to this particular application or example. As described above, various sheet registration/deskewing systems may be installed in a selected location or locations of the paper path or paths of various printing machines, especially high speed xerographic reproduction machines, for rapidly deskewing and otherwise registering a sequence of print media sheets 12 without having to stop the sheets, and without having to damage sheet edges by contacting obstructions, as taught by the above and other references. Only a portion of some exemplary baffles 14 partially defining an exemplary printer paper path is illustrated in FIG. 1, and there is also no need to disclose other conventional details of a xerographic or other printer.

The registration system 10 in this example (as in said prior application's FIG. 6) has a positive sheet 12 drive in the process direction from two laterally spaced frictional elastomeric surface sheet drive rollers 15A, 15B and mating idler rollers 16A, 16B forming first and second drive nips 17A, 17B. A single servo or stepper motor M1 sheet drive here is positively driving both sheet feeding nips 17A, 17B. As will be further described, also provided here is a much smaller, lower cost, lower power, and lower mass differential actuator drive motor M2 for sheet deskewing by differential rotation of drive roller 15A relative to 15B, and a motor M3 providing for lateral sheet registration with the same integrated system 10, although that is only an optional feature here.

The two drive nips 17A, 17B are driven at substantially the same rotational speed to feed the sheet 12 in those nips downstream in the paper path at the desired forward process speed and in the correct process registration position, except when the need for deskewing the incoming sheet 12 is detected by the above-cited or other conventional optical sensors such as 120A, 120B in the sheet path, which need not be shown here. That is, when the sheet 12 has arrived in the system 10 in an initially detected undesired skewed orientation. In that case, as further described below and reference-cited, a corresponding pitch change by small rotary positional changes provides driving difference between the two drive roller 15A, 15B, is made during the time the sheet 12 is passing through, and held in, the two sheet feeding nips 17A, 17B. This accomplishes the desired sheet deskew (skew correction) by a partial sheet rotation. In this particular system 10 (but not limited thereto) only a single servo-motor M1 is needed to positively drive both drive rollers 15A, 15B, even though their respective forward driving differs slightly as just described to provide differential sheet rotation in the nips 17A, 17B for sheet deskew.

As taught by various above-cited references, in a TELER system, a combined sheet deskew and forward registration system may be mounted on various lateral rails, rods or carriages so as to be laterally driven by any of various direct or indirect driving connections with another such servo or stepper motor, such as M3 here, to provide lateral movement of the unit and therefore lateral movement of its nips. However, the particular system 10 in this example does so with lateral movement of an unusually low mass, including no required lateral movement of the drive motor M1.

While various different deskew systems can utilize the deskewing accuracy improvement disclosed herein and be optionally combined with various different lateral sheet registration systems, the particular embodiment or species of FIG. 1 here, and alternatives thereof, has some particular advantages, especially for an integral high speed sheet deskew, forward, and lateral registration system 10, as will be apparent from the following description thereof.

As shown in FIG. 1, the single motor M1 providing both of the nip 17A, 17B drives is driving a gear 80 via a timing belt. This elongated straight gear 80 drivingly engages a straight gear 82, which in turn drivingly engages a straight gear 81. The gear 81 is directly connected to the sheet drive roller 15A defining the first drive nip 17A. Both gear 81 and its connected sheet drive roller 15A are freely rotatably mounted on a mounting shaft 92B. The gear 82 is connected to and rotates an interconnecting hollow drive shaft 83, which rotates around a shaft 89 which can translate but does not need to rotate. The straight gears 80 and 81 have enough lateral (axial) teeth extension so that the gear 82 and its shafts 83 and 89 are able to move laterally relative to the gears 81 and 80 and still remain engaged.

At the other end of this same hollow drive shaft 83 (which is being indirectly but positively rotatably driven by the motor M1 via gears 80 and 82), there is mounted a helical gear 84, which thus rotates with the rotatable drive of the gear 82. This helical gear 84 drivingly engages another helical gear 85, which is fastened to the drive roller 15B of the second nip 17B to rotatably drive them (rotating on the shaft 92B). Thus, absent any axial movement of the shafts 83 and 89, the motor M1 is positively driving both of the sheet nips 17A and 17B with essentially the same rotational speed, to provide essentially the same sheet 12 forward movement. The hollow drive shaft 83 is providing a laterally translatable tubular drive connecting member between the two gears 82 and 84, and thus the two gears 81, 85 and thus the two drive rollers 15A, 15B, to form part of the differential drive deskewing system.

The desired amount of deskew is provided in this example by slightly varying the angular position of the nip 17B relative to the nip 17A for a predetermined time period by the deskewing differential drive system. Here in the FIG. 1 example the particular differential drive system is powered by intermittent rotation of a deskew motor M2 controlled by the controller 100. The deskew motor M2 here is fastened to the shaft 92B by a connector 88, and thus moves laterally therewith. When the deskew motor M2 is actuated by the controller 100 it rotates its screw shaft 87. The screw shaft 87 engages with its screw threads the mating threads of a female nut 86, or other connector, such that rotation of the screw shaft 87 by the motor M2 moves the shaft 89 (and thus hollow shaft 83) axially towards or away from the motor M2, depending on the direction of rotation of its screw shaft 87. A relatively small such axial or lateral movement of the shaft 83 moves its two attached gears 82 and 84 laterally relative to the opposing shaft 92B on which is mounting the drive rollers 15A, 15B and their respective gears 81 and 85. The straight gear 82 can move laterally relative to its mating straight gear 81 without causing any relative rotation. However, in contrast, the translation of the mating helical gear connection between the gears 84 and 85 causes a rotational shift of the nip 17B relative to the nip 17A. That change (difference) in the nips rotational positions is in proportion to, and corresponds to, the amount of rotation of the screw shaft 87 by the deskew motor M2. This provides the desired sheet deskew. Reversal of the deskew motor M2 when a sheet is not in the nips 17A, 17B can then re-center the deskew system, if desired.

The female nut 86, as shown, provides spacing for substantial unobstructed lateral movement of the end of the screw shaft 87 therein as the screw shaft 87 rotates in the mating threads of the nut 86. The nut 86 also has an anti-rotation arm 86A, which, as illustrated can slideably engage a bar or other fixed frame member with a linear bushing between the end of the anti-rotation arm 86A and that stationary member. Thus, the nut 86 does not need a rotary bearing to engage and move the non-rotating center shaft 89, and can be fastened thereto. Of course, alternatively, if desired, it could move the rotating outer tubular connecting shaft 83 laterally through a rotary bearing.

Turning now to the integral lateral or sideways to process direction sheet registration system of this particular TELER registration system 10, as noted elsewhere herein, reducing as much as possible the mass of the components which must be laterally moved is very desirable for a sheet lateral registration system, especially for re-centering it rapidly between sheets. This is provided here by having only the relatively low mass components that need to move laterally for sheet lateral registration to be mounted on a unit 92 comprising parallel upper and lower arms or shafts 92A and 92B. In this particular FIG. 1 illustration this nips lateral translation unit 92 of shafts 92A and 92B appears "U"-shaped or "trombone slide"-shaped, but that is not essential. Although these two shafts 92A and 92B are shown fastened together on the left outside here, they could be fastened together elsewhere. These shafts 92A and 92B are non-rotating shafts that may be laterally slideably mounted through the frames of the overall unit 10, as is also the left end of the parallel shaft 89.

The lateral (side-shifting) movement imparted to this unit 92 here is from the motor M3 driving the unit 92 via a rack and gear drive 90. The amount of lateral sheet 12 shifting here is thus controlled by the controller 100 controlling the amount of rotation of the motor M3. But the motor M3 itself is not part of the laterally moving mass. It is stationary and fixed to the machine frame.

The nip 1A, 17B idlers 16A and 16B are freely rotatable on the transverse upper arm or shaft 92A, but are also mounted to move laterally when the unit 92 is so moved by the motor M3. Likewise, the gear 81 and its connecting drive roller 15A, and the gear 85 and its connecting drive roller 15B, are freely rotatable relative to the lower arm or shaft 92B, but mounted to move laterally when that arm or shaft 92B is moved laterally by the motor M3 gear drive 90. Since the upper and lower shafts 92A and 92B are parallel and are fastened together into a single slide unit 92, the drive rollers 15A, 15B will move laterally by same amount as the idlers 16A and 16B, to maintain, but laterally move, the two nips 17A, 17B.

As noted above, also attached to move laterally with the unit 92 is a coupling 88 mounting the deskew motor M2 to the lower arm 92B, so that the lateral sheet registration movement of the unit 92 also laterally moves the motor M2, its screw shaft 87, and thus the shaft 89, via its coupling 86.

Thus, it may be seen that the drive nips 17A and 17B and their deskew system can all be laterally shifted for lateral sheet registration without changing either the forward sheet speed and registration or the sheet deskewing positions while the lateral sheet registration is accomplished. That is, the deskewing operation controlled by the motor M2 is independent of the lateral registration movement provided by the motor M3. This allows all three registration movements of the sheet 12 to be desirably accomplished simultaneously, partially overlapping in time, or even separately. Yet neither the mass of the drive motor M1 or the mass of the lateral registration drive M3 need be moved for lateral sheet registration. Both may be fixed position motors.

Note however, the various alternative sheet deskewing system embodiments of other above-cited and other art. Also, it will be appreciated that some components may be vertically reversed in position, such as having the idlers mounted below the paper path and the two drive rollers mounted above the paper path.

Turning now to the particular subject added features of this FIGS. 1-3 registration system 10 embodiment differing from or adding to the first paragraph cross-referenced co-pending application FIG. 6 embodiment, it may be seen that here conventional rotary encoders 110A and 110B are respectively mounted to each of the laterally spaced and undriven independently freely rotatable idler rollers 16A and 16B. These rotary encoders may be mounted on either side of the idler rollers 16A and 16B, and provide output signals to controller 100 directly signaling the rotation thereof in an otherwise known manner. That is, accurately independently signaling the respective rotary positions of the respective idlers 16A and 16B which are mating with nip normal force with their respective frictional-drive deskewing and sheet drive rollers 15A, 15B. These idlers 16A and 16B are not subject to any driving forces, and can be hard metal or plastic instead of an elastomeric material (unlike the drive rollers 15A, 15B). Thus, these idlers 16A and 16B need not be deformed by nip forces, or have any slip relative to sheet 12. Thus, these idlers can have rotational velocities directly corresponding to the actual surface velocity of the sheet 12 in their respective nips 17A and 17B. Thus, the respective 16A and 16B idler rotations accurately correspond to their engaged sheet 12 movement, and that information can be accurately recorded by the conventional pulse train output signals of conventional optical or magnetic rotary shaft encoders 110A and 110B and sent to the controller 100 here. Those encoder signals can also be compared with known information in comparative software or circuitry in the controller 100, or elsewhere.

High-resolution encoders may not be necessary in this application. It is believed that relatively low resolution, and hence low cost, encoders 110A and 110B may suffice in this function. For example, 500 count per revolution encoders (1000 optically detectable encoder mark edges per revolution) are commercially available and are relatively inexpensive. They may be sufficient even without extrapolation. However, extrapolation can be used to further enhance their sheet position measurement accuracy. There are several different known techniques for extrapolating positions between the detected encoder mark edges or their encoder output pulses. Such extrapolation is known, for example, for generating dot clocks (reflex printing clocks) at higher resolution than the process direction (drum) encoder resolution of an encoder connected to a rotating printer photoreceptor or photoreceptor drive member. Encoder extrapolation techniques have also been used for some low-resolution encoders in media feeder servo feedback applications. One method for encoder extrapolation is described, for example, in David Knierim U.S. Pat. No. 6,076,922, issued Jun. 20, 2000.

Another way to utilize the encoders 11A and 110B here is to measure the slip (the difference between the drive roller rotary position and idler roller rotary position) only at the idler encoder mark edges. This assumes that the drive roller position is known to a relatively high resolution, which is likely with, for example, the illustrated large gear reduction provided by gears 80 and 82 between the drive servo motor M1 and the drive rollers 15A and 15B.

By way of further explanation, it was discovered that the final sheet skew and position provided by such a TELER or ELER registration system is not sufficiently defined by the position of the driven sheet drive rollers for high precision printing or the like, and that a form of continuing feedback of accurate sheet skew and position information was needed to more accurately fix sheet skew and process direction registration to sufficiently desired close tolerances for accurate printing. Rather than adding expensive large area or movable sensors, it has been found that after sheet lead edge sensors measure initial skew and sheet process direction position, that idler roller encoders can accurately measure changes in skew and process direction position from then on. These encoders may then provide additional fine adjustment servo feedback for the TELER or ELER nip drive motors. A possible additional advantage may be to avoid the cost of encoders on the ELER drive motors themselves, in using servo motors instead of stepper motors for the nip drives.

The disclosed embodiment may be referred to as an "ESP" ("Encoded Skew and Process") system and method of improved registration accuracy. It can continuously obtain more accurate sheet velocity measurements at two transverse positions so as to continuously measure the actual paper trajectory as the paper progress from the input to the output of the sheet registration system. Thus, a more accurate feedback control system can be provided to invoke corrective commands to the inboard and outboard sheet drive nips to force the sheet to more closely follow the desired sheet trajectory. It has been found that a particularly suitable source and location for these sheet velocity measurements is through encoders that are mounted on the sheet drive nip idler rolls of the sheet registration system. The Figs. show one such exemplary implementation. As already taught in the above-cited prior such registration systems, such as U.S. Pat. Nos. 6,575,458 and 6,535,268, the differential angular positions of the inboard and outboard nips relative to one another can determine the corrective skew of the sheet, while the average velocity of the inboard and outboard nips together determines the process registration and thus the timely delivery of the sheet to the next sheet feed nip or the image transfer station. These drive nips are defined by drive rollers and idler rollers. Here, as will be further described, the idler rollers have respective rotary position encoders mounted on them. The relative positions of the drive rollers and idler rollers on opposite sides of the paper path can of course be reversed from that illustrated in this example.

A further description of this "ESP" (Encoded Skew and Process) registration strategy follows. The skew and process direction of the paper in the registration systems nips 17A, 17B is measured and used to control the paper progress from those nips to the transfer station 140, which can be, for example, a conventional xerographic electrostatic toner image to sheet 12 transfer station, or, as shown in the example of FIGS. 2 and 3, a pressure transfuse hot wax image transfer nip, etc.

1. The initial sheet 12 skew angle and its process direction arrival time may be conventionally measured when the sheet edge arrives at the transverse upstream optical sensors 120A, 120B, or elsewhere in the paper path, as in various of the above-cited patents.
2. The registration system controller generates appropriate commands to the registration system drive roller drives for the desired skew and process registration correction of the sheet trajectory, as in the above-cited patents.
3. Assume that heater and/or baffle induced drag forces or other disturbances cause the sheet to deviate from the corrected sheet trajectory that was intended to be provided in step 2. The idler encoders such as 110A and 110B measure this deviation, and the registration controller 100 generates appropriate command signals to the registration system drive roller drives to compensate for such deviations. That is, this registration strategy can measure the skew error from the two encoder outputs and can execute a closed loop skew correction with those signals. That correction can last while the sheet is in the nips of the registration system, or last as long as a trailing end area of the sheet of paper is being transported through the upstream heaters, baffles, or other sources of drag and/or skewing forces on the sheet which may be present in the particular application of the subject ESP system. Note that a drive ratio differential of only 0.0065 can produce a 0.81 mm process direction error per driver roller revolution for a 40 mm diameter drive roller.

If the particular printer in which the subject registration improvement system is used is a hot wax imaging material printer, then said pre-transfer sheet heaters may be more likely to be provided in the printer paper path. Such a sheet heater 130 is schematically shown in FIG. 2 upstream of the registration nips 17A and 17B. However, such heaters can additionally or alternatively be provided downstream thereof between the registration nips 17A and 17B and the pressure (or other) image transfer station 140.

Note that this ESP registration improvement strategy is for skew and process direction registration correction. It does not change the lateral sheet registration system. However, it is fully compatible and combinable therewith, as shown by its incorporation into the "TELER" embodiment of FIG. 1.

To summarize, in this exemplary ESP paper registration system embodiment, important attributes include providing [after the existing initial sheet skew and process direction measurement] a method of continuously measuring the actual surface velocity of the sheet in two transverse positions during the sheet registration process. This measures the actual achieved skew and process direction positions of the sheet [as compared to the initial skew and process direction being corrected] as the sheet moves from the input to the output of the sheet registration system. The information as to both the initial measurements and these continuous measurements may be used in a feedback loop to better control the actual trajectory of the sheet to more closely approximate the desired trajectory.

As additional embodiment suggestions, it is believed that increasing the nip width will increase and thus help improve the drive ratio, i.e., to bring the drive ratio closer to unity. Some test data showed an approximately 30% improvement in drive ratio effect as the nip width was increased from 6 to 12 mm. However, this effect is probably nonlinear, hence increasing nip width is expected to have diminishing returns. One exemplary nip width was 10 mm. Increasing the nip normal force, as by a stronger spring force on the idler shaft, can reduce slip and improve the drive ratio. However, as noted above, this can cause other problems and too much such loading is undesirable.

It is also desirable for the idler to have low inertia, such as by relatively low mass, small diameter rollers. This helps insure tracking movement with the sheet surface even if the sheet has accelerations or decelerations.

It is desirable that the distance from the two transverse sheet edge sensors 120A and 120B (providing initial sheet skew and position information to the registration system 10) to the image transfer station nip 140 (the next sheet nip, in this example), divided by the circumference of the idler rollers 16A, 16B, closely approximate an integer. This minimizes once-around (one revolution of each idler roller) error and simplifies the correction process. It is also desirable, although less important, to have the drive nip and its drive train components each rotate an integer number of times as the media travels from the two transverse sheet edge sensors 120A and 120B to the image transfer station nip 140.

It is also desirable that both idlers (the inboard and outboard idlers) be mounted on a single shaft, as shown. This minimizes skew errors due to relative axial misalignment of the idlers, which might otherwise be difficult to correct.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An improved sheet registration system for a moving sheets path for accurately correcting a sheet position relative to a desired sheet trajectory, said sheet registration system including a control system and at least one frictional sheet drive roller with a drive system and a mating undriven idler roller forming at least one sheet trajectory controlling sheet drive nip between said at least one frictional sheet drive roller and said mating undriven idler roller, wherein said mating undriven idler roller has non-slip rotational engagement with said sheet in said at least one sheet drive nip to rotate in correspondence with said sheet trajectory, and wherein said mating undriven idler roller has a rotary encoder operatively connected thereto to produce encoder electrical signals corresponding to said rotation of said mating undriven idler roller, which encoder electrical signals are provided to said control system to control said drive system driving said at least one frictional sheet drive roller, wherein said at least one frictional sheet drive roller comprises a transversely spaced pair of such drive rollers with a differential drive system providing differential sheet drive nips, and said differential drive system is controlled by said control system to impart sheet trajectory controlling skew corrective motion including partial rotation of a sheet in said differential sheet drive nips.

2. An improved sheet registration method for a moving sheets path for accurately correcting an initially detected sheet position and skew relative to a desired sheet trajectory, said sheet registration method including a control system and at least two transversely spaced apart frictional sheet drive rollers driven by a differential drive system and having mating undriven idler rollers forming at least two sheet trajectory controlling sheet drive nips between said at least two frictional sheet drive rollers and said respective mating undriven idler rollers, wherein said at least two frictional sheet drive rollers and said differential drive system are controlled by said control system to impart corrective motion to said sheet in said sheet trajectory controlling sheet drive nips, wherein said mating undriven idler rollers have non-slip rotational engagement with said sheet in said at least two sheet trajectory controlling sheet drive nips to rotate in correspondence with said sheet trajectory, and wherein said mating undriven idler rollers have rotary encoders operatively connected thereto producing encoder electrical signals corresponding to said rotation of said mating undriven idler rollers, which encoder electrical signals are provided to said control system to control said differential drive motor system driving said at least two frictional sheet drive rollers to substantially correct for errors in said driving of said sheet by said frictional sheet drive rollers in said sheet trajectory controlling sheet drive nips.

3. The improved sheet registration method of claim 2, wherein said moving sheets path is a paper path in a printer.

4. The improved sheet registration method of claim 2, wherein said moving sheets path is a paper path in a printer upstream of an image transfer station at which images are printed on the sheets registered by said improved sheet registration method.

5. The improved sheet registration method of claim 2, wherein said rotary encoders are directly attached to said undriven idler rollers and said undriven idler rollers are all rotatably mounted on the same transverse shaft.

6. The improved sheet registration method of claim 2, wherein at least the outer surface of said frictional sheet drive rollers has a partially deformable elastomeric frictional surface, and said mating undriven idler rollers have a substantially non-deformable surface, and wherein said moving sheets path is a paper path of a printer with sheet path defining baffles imparting drag forces on said moving sheets when said sheets are in said in said sheet trajectory controlling sheet drive nips, which drag forces are sufficient to cause partial deformation of said partially deformable elastomeric frictional surface of said frictional sheet drive rollers.

7. A sheet registration method for a moving sheets path of a printer for more accurately correcting an initially detected sheet position relative to a desired sheet trajectory, said sheet registration method including a control system and transversely spaced apart elastomer surface frictional sheet drive rollers driven by a drive motor system and having mating undriven non-elastomeric idler rollers forming sheet trajectory controlling sheet drive nips between said frictional sheet drive rollers and said respective mating undriven idler rollers, said sheet trajectory controlling sheet drive nips providing forward driving of a sheet therein, said mating undriven idler rollers having rotary encoders producing encoder signals directly corresponding to the rotation of said mating undriven idler rollers, which encoder signals are provided to said control system to control said sheet drive rollers to correct for errors in said desired trajectory of said sheet caused by sheet drag forces acting on said elastomer surface sheet drive rollers in said sheet drive nips.

8. The sheet registration method Of claim 7, wherein the distance between said sheet drive nips and a downstream sheet drive nip divided by the circumference of said idler rollers is approximately an integer.

9. The sheet registration method of claim 7, wherein said sheet drive nips are approximately 6 to 12 mm wide.

* * * * *